US009635473B2

(12) United States Patent
Guo et al.

(10) Patent No.: US 9,635,473 B2
(45) Date of Patent: Apr. 25, 2017

(54) HEARING DEVICE COMPRISING A GSC BEAMFORMER

(71) Applicant: OTICON A/S, Smørum (DK)

(72) Inventors: Meng Guo, Smørum (DK); Jan Mark de Haan, Smørum (DK); Jesper Jensen, Smørum (DK)

(73) Assignee: OTICON A/S, Smorum (DK)

( * ) Notice: Subject to any disclaimer, the term of this patent is extended or adjusted under 35 U.S.C. 154(b) by 0 days.

(21) Appl. No.: 14/855,979

(22) Filed: Sep. 16, 2015

(65) Prior Publication Data

US 2016/0080873 A1 Mar. 17, 2016

(30) Foreign Application Priority Data

Sep. 17, 2014 (EP) ..... 14185117

(51) Int. Cl.
*H04R 25/00* (2006.01)
*H04R 3/00* (2006.01)
*H04R 5/033* (2006.01)

(52) U.S. Cl.
CPC ..... *H04R 25/405* (2013.01); *H04R 3/005* (2013.01); *H04R 25/505* (2013.01); *H04R 5/033* (2013.01); *H04R 25/407* (2013.01); *H04R 2225/67* (2013.01); *H04R 2430/25* (2013.01)

(58) Field of Classification Search
CPC .. H04R 25/405; H04R 25/505; H04R 25/407; H04R 3/005; H04R 2225/67; H04R 2430/25
See application file for complete search history.

(56) References Cited

U.S. PATENT DOCUMENTS

2009/0175466 A1* 7/2009 Elko ..... H04R 3/005 381/94.2
2011/0075859 A1* 3/2011 Kim ..... H04R 3/005 381/92
2012/0057722 A1 3/2012 Osako et al.
(Continued)

FOREIGN PATENT DOCUMENTS

WO WO 2006/006935 A1 1/2006
WO WO 2012/061151 A1 5/2012

*Primary Examiner* — Tuan D Nguyen
(74) *Attorney, Agent, or Firm* — Birch, Stewart, Kolasch & Birch, LLP

(57) ABSTRACT

The application relates to a hearing device comprising a beamformer of the generalized sidelobe canceler (GSC) type. The application further relates to a method of operating a hearing device. The disclosure addresses a problem which occurs when using a GSC structure in a hearing device application. The problem arises due to a non-ideal target-cancelling beamformer. As a consequence, a target signal impinging from the look direction can—unintentionally—be attenuated by as much as 30 dB. To resolve this problem, it is proposed to monitor the difference between the output signals from the all-pass beamformer and the target-cancelling beamformer to control a time-varying regularization parameter in the GSC update. This has the advantage of providing a computationally simple solution to the non-ideality of the GSC beamformer. The invention may e.g. be used in hearing aids, headsets, ear phones, active ear protection systems, or combinations thereof.

15 Claims, 5 Drawing Sheets

(56) References Cited

U.S. PATENT DOCUMENTS

| | | | | |
|---|---|---|---|---|
| 2012/0082322 | A1* | 4/2012 | van Waterschoot | G10L 21/0316 381/92 |
| 2014/0056435 | A1* | 2/2014 | Kjems | H04M 9/082 381/66 |

* cited by examiner

HEARING DEVICE COMPRISING A GSC BEAMFORMER

TECHNICAL FIELD

The present application relates to adaptive beamforming. The disclosure relates specifically to a hearing device comprising an adaptive beamformer, in particular to a generalized sidelobe canceller structure (GSC).

The application furthermore relates to a method of operating a hearing device and to a data processing system comprising a processor and program code means for causing the processor to perform at least some of the steps of the method.

Embodiments of the disclosure may e.g. be useful in applications such as hearing aids, headsets, ear phones, active ear protection systems, or combinations thereof, handsfree telephone systems (e.g. car audio systems), mobile telephones, teleconferencing systems, public address systems, karaoke systems, classroom amplification systems, etc.

BACKGROUND

In a hearing aid application, the microphone array is typically placed closely to the ear of the hearing aid user to ensure that the array picks up most realistic sound signals for a natural sound perception. Therefore, the transfer functions $d_m(k)$ from a target sound source to individual microphones (m=1, 2, . . . , M) vary over hearing aid users, where k is a frequency index. A look vector d(k) is defined as $d(k)=[d_1(k), d_M(k)]^T$.

In practical applications, the look vector d(k) is unknown, and it must be estimated. This is typically done in a calibration procedure in a sound studio with a hearing aid mounted on a head-and-torso simulator. Furthermore, the beamformer coefficients are constructed based on an estimate $d_{est}(k)$ of the look vector d(k).

As a result of using the look vector estimate $d_{est}(k)$ rather than d(k), the target-cancelling beamformer does not have a perfect null in the look direction, it has a finite attenuation (e.g. of the order of 10-30 dB). This phenomenon allows the GSC to—unintentionally—attenuate the target source signal while minimizing the GSC output signal e(k,n).

SUMMARY

In the present disclosure, column vectors and matrices are emphasized using lower and upper letters in bold, respectively. Transposition, Hermitian transposition and complex conjugation are denoted by the superscripts T, H and *, respectively.

An object of the present application is to provide an improved hearing device. A further object is to provide improved performance of a directional system comprising a generalized sidelobe canceller structure.

Objects of the application are achieved by the invention described in the accompanying claims and as described in the following.

A Hearing Device:

In an aspect of the present application, an object of the application is achieved by a hearing device comprising a microphone array for picking up sound from a sound field including a target sound source in the environment of the hearing device, the microphone array comprising a number M of microphones for picking up each their version of the sound field around the hearing device and providing M electric input signals, a look vector d(k) being defined as an M-dimensional vector comprising elements $d_m(k)$, m=1, 2, . . . , M, the $m^{th}$ element $d_m(k)$ defining an acoustic transfer function from the target signal source to the $m^{th}$ microphone, or a relative acoustic transfer function from the $m^{th}$ (input) microphone to a reference microphone, where k is a frequency index, A look vector unit for providing an estimate $d_{est}(k)$ of the look vector d(k) for the (currently relevant) target sound source, a generalized sidelobe canceller for providing an estimate e(k,n) of a target signal s(k,n) from said target sound source, where n is a time index, a target direction being defined from the hearing device to the target sound source, the generalized sidelobe canceller comprising an all-pass beamformer configured to leave all signal components from all directions un-attenuated, and providing all-pass signal $y_c(k,n)$, and a target-cancelling beamformer configured to maximally attenuate signal components from the target direction, and providing target-cancelled signal vector $y_b(k,n)$, where $y_b(k,n)$ $[y_{b,1}(k,n), . . . , y_{b,M-1}(k,n)]^T$, and $y_{b,i}(k,n)$ is the $i^{th}$ target-cancelled signal, a scaling unit for generating a scaling vector h(k,n) applied to the target-cancelled signal vector $y_b(k,n)$ providing scaled, target-cancelled signal $y_n(k,n)$, a combination unit for subtracting said scaled, target-cancelled signal $y_n(k,n)$ from said all-pass signal $y_c(k,n)$, thereby providing said estimate e(k,n) of said target signal s(k,n), wherein the M electric input signals from the microphone array and the look vector unit being operationally connected to the generalized sidelobe canceller, wherein the scaling unit is configured to provide that said scaling vector h(k,n) is made dependent on a difference $\Delta_i(k,n)$ between the energy of the all-pass signal $y_c(k,n)$ and the energy of the target-cancelled signal $y_{b,i}(k,n)$, where i is an index from 1 to M−1.

Thereby a computationally simple solution to the non-ideality of the GSC beamformer is provided. A further advantage may be that no artifacts are thereby introduced in the output signal.

In an embodiment, the M electric input signals from the microphone array are connected to the generalized sidelobe canceller (see e.g. unit GSC in FIG. 1A, 1B). The M electric input signals are preferably used as inputs to the generalized sidelobe canceller (as e.g. illustrated in FIG. 1). In an embodiment, the look vector unit (see e.g. unit LVU in FIG. 1B) is connected to the generalized sidelobe canceller (see e.g. unit GSC in FIG. 1A, 1B). The look vector unit provides an estimate $d_{est}(k)$ of the look vector d(k) for the (currently relevant) target sound source. The estimate of the look vector is generally used as an input to the generalized sidelobe canceller (as e.g. illustrated in FIG. 1). The generalized sidelobe canceller processes the M electric input signals from the microphone array and provides an estimate e of a target signal s from a target sound source represented in the M electric input signals (based on the M electric input signals and the estimate of the look vector, and possibly on further control or sensor signals). The (currently relevant) target sound source may e.g. be selected by the user, e.g. via a user interface or by looking in the direction of such sound source. Alternatively, it may be selected by an automatic procedure, e.g. based on prior knowledge of potential target sound sources (e.g. frequency content information, modulation, etc.).

In an embodiment, the characteristics (e.g. spatial fingerprint) of the target signal is represented by the look vector d(k,m) whose elements (i=1, 2, . . . , M) define the (frequency and time dependent) absolute acoustic transfer function from a target signal source to each of the M input units (e.g. input transducers, such as microphones), or the relative acoustic transfer function from the $i^{th}$ input unit to a reference input unit. The look vector d(k,m) is an M-dimensional vector, the $i^{th}$ element $d_i(k,m)$ defining an acoustic transfer function from the target signal source to the $i^{th}$ input unit (e.g. a microphone). Alternatively, the $i^{th}$ element $d_i(k,m)$ define the relative acoustic transfer function from the $i^{th}$ input unit to a reference input unit (ref). The vector element $d_i(k,m)$ is typically a complex number for a specific frequency (k) and time unit (m). In an embodiment, the look vector is predetermined, e.g. measured (or theoretically determined) in an off-line procedure or estimated in advance of or during use. In an embodiment, the look vector is estimated in an off-line calibration procedure. This can e.g. be relevant, if the target source is at a fixed location (or direction) compared to the input unit(s), if e.g. the target source is (assumed to be) in a particular location (or direction) relative to (e.g. in front of) the user (i.e. relative to the device (worn or carried by the user) wherein the input units are located).

In general, it is assumed that the 'target sound source' (equivalent to the 'target signal source') provides the 'target signal'.

It is to be understood that the all-pass beamformer is configured to leave all signal components from all directions (of the M electric input signals) un-attenuated in the resulting all-pass signal $y_c(k,n)$. Likewise, it is to be understood that the target-cancelling beamformer is configured to maximally attenuate signal components from the target direction (of the the M electric input signals) in the resulting target-cancelled signal vector $y_b(k,n)$.

In an embodiment, the hearing device comprises a voice activity detector for—at a given point in time—estimating whether or not a human voice is present in a sound signal. In an embodiment, the voice activity detector is adapted to estimate—at a given point in time—whether or not a human voice is present in a sound signal at a given frequency. This may have the advantage of allowing the determination of parameters related to noise or speech during time segments where noise or speech, respectively, is (estimated to be) present. A voice signal is in the present context taken to include a speech signal from a human being. It may also include other forms of utterances generated by the human speech system (e.g. singing). In an embodiment, the voice activity detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only comprising other sound sources (e.g. naturally or artificially generated noise). In an embodiment, the voice activity detector is adapted to detect as a VOICE also the user's own voice. Alternatively, the voice activity detector is adapted to exclude a user's own voice from the detection of a VOICE. In an embodiment, the hearing device comprises a dedicated own voice activity detector for detecting whether a given input sound (e.g. a voice) originates from the voice of the user of the device.

In an embodiment, the scaling vector h(k,n) is calculated at time and frequency instances n and k, where no human voice is estimated to be present (in the sound field). In an embodiment, the scaling vector h(k,n) is calculated at time and frequency instances n and k, where only noise is estimated to be present (in the sound field).

The difference $\Delta_i(k,n)$ between the energy of the all-pass signal $y_c(k,n)$ and target-cancelled signal $y_{b,i}(k,n)$ can be estimated in different ways, e.g. over a predefined or dynamically defined time period. In an embodiment, the time period is determined in dependence of the expected or detected acoustic environment.

In an embodiment, a difference $\Delta_i(k,n)$ between the energy of the all-pass signal $y_c(k,n)$ and target-cancelled signal $y_{b,i}(k,n)$ is expressed by $$\Delta_i(k,n) = \frac{\sum_{l=0}^{L-1} |y_c(k,n-l)|^2}{\sum_{l=0}^{L-1} |y_{b,i}(k,n-l)|^2}$$

where i=1, 2, . . . , M−1, and where L is the number of data samples used to compute $\Delta_i(k,n)$.

The term 'difference' between two values or functions is in the present context taken in a broad sense to mean a measure of the absolute or relative deviation between the two values or functions. In an embodiment, the difference between two values ($v_1$, $v_2$) is expressed as a ratio of the two values ($v_1/v_2$). In an embodiment, the difference between two values is expressed as an algebraic difference of the two values ($v_1-v_2$), e.g. a numeric value of the algebraic difference ($|v_1-v_2|$).

According to the present disclosure, the scaling vector h(k,n) is made dependent on the difference Δi(k,n) between the energy of the all-pass signal $y_c(k,n)$ and target-cancelled signal $y_{b,i}(k,n)$ thereby providing a modified scaling vector $h_{mod}(k,n)$.

In an embodiment, a modified scaling factor $h_{mod,i}(k,n)$ is introduced, and it is defined as $$h_{mod,i}(k,n) = \begin{cases} h_i(k,n) & \text{for } \Delta_i(k,n) \le \eta_i \\ 0 & \text{otherwise} \end{cases},$$

where i=1, 2, . . . , M−1. The threshold value $\eta_i$ is determined by the difference between the magnitude responses of the all-pass beamformer c and the target-cancelling beamformer B for each target-cancelled signal $y_{b,i}(k,n)$ in a look direction. The modified scaling factors $h_{mod,i}(k,n)$ (i=1, 2, . . . , M−1) define the modified scaling vector $h_{mod}(k,n)$. The look direction is defined as a direction from the input units (microphones $M_1$, $M_2$) towards the target sound source as also determined by the look vector (in some scenarios, the look direction is equal to the direction that the user looks (e.g. when it is assumed that the user looks in the direction of the target sound source)).

In an embodiment, the threshold value $\eta_i$ is in the range between 10 dB and 50 dB, e.g. of the order of 30 dB.

In an embodiment, where M=2 (two microphones), the difference Δ(k,n) between the energy of the all-pass signal $y_c(k,n)$ and target-cancelled signal $y_b(k,n)$ is expressed by $$\Delta(k,n) = \frac{\sum_{l=0}^{L-1} |y_c(k,n-l)|^2}{\sum_{l=0}^{L-1} |y_b(k,n-l)|^2}$$

where L is the number of data samples used to compute $\Delta(k,n)$.

In an embodiment, L is configurable, depending on a sampling rate fs in the hearing device. In an embodiment, where the sampling rate $f_s$=20 kHz, a good choice for L is in the range from 100 to 400 (which corresponds to 5-20 ms). In an embodiment, L is dynamically determined in dependence of the current acoustic environment (e.g. the nature of the target signal and/or the noise signals currently present in the environment of the user).

In an embodiment, where M=2 (two microphones), the scaling factor h(k,n) is unmodified in case the difference $\Delta(k,n)$ is smaller than or equal to a predetermined threshold value $\eta$ (meaning that $y_n(k,n)=y_c(k,n)*h(k,n)$). In an embodiment, the scaling factor h(k,n) is zero in case the difference $\Delta(k,n)$ is larger than a predetermined threshold value $\eta$ (meaning that $y_n(k,n)=y_c(k,n)*h(k,n)=0$). This may have the advantage of providing an appropriate behavior of the GSC beamformer for signals from the look direction.

In an embodiment, the threshold value $\eta$ is determined by the difference between the magnitude responses of the all-pass beamformer and the target-cancelling beamformer in the look direction. Thereby an appropriate threshold value $\eta$ can be determined. In an embodiment, the threshold value $\eta$ is in the range between 10 dB and 50 dB, e.g. of the order of 30 dB.

In an embodiment, the estimate $d_{est}(k)$ of said look vector d(k) for the currently relevant target sound source is stored in a memory of the hearing device. In an embodiment, the estimate $d_{est}(k)$ of the look vector d(k) for the currently relevant target sound source is determined in an off-line procedure, e.g. during fitting of the hearing device to a particular user, or in a calibration procedure where the hearing device is positioned on a head-and-torso model located in a sound studio.

In an embodiment, the hearing device is configured to provide that the estimate $d_{est}(k)$ of said look vector d(k) for the currently relevant target sound source is dynamically determined. Thereby, the GSC beamformer may be adapted to moving sound sources and target sound sources that are not located in a fixed direction (e.g. a front direction) relative to the user.

In an embodiment, the target-cancelling beamformer does not have a perfect null in the look direction. This is a typical assumption, in particular when the output of the GSC-beamformer is based on a (possibly predetermined) estimate of the look vector.

In an embodiment, the hearing device comprises a user interface allowing a user to influence the target-cancelling beamformer. In an embodiment, the hearing device is configured to allow a user to indicate a current look direction via a user interface (if, e.g., a current look direction deviates from the assumed look direction). In an embodiment, the user interface comprises a graphical interface allowing a user to indicate a current location of the target sound source relative to the user (whereby an appropriate look vector can be selected for current use, e.g. selected from a number of predetermined look vectors for different relevant situations).

In an embodiment, the hearing device is adapted to provide a frequency dependent gain and/or a level dependent compression and/or a transposition (with or without frequency compression) of one or frequency ranges to one or more other frequency ranges, e.g. to compensate for a hearing impairment of a user. In an embodiment, the hearing device comprises a signal processing unit for enhancing the input signals and providing a processed output signal. Various aspects of digital hearing aids are described in [Schaub; 2008].

In an embodiment, the hearing device comprises an output unit for providing a stimulus perceived by the user as an acoustic signal based on a processed electric signal. In an embodiment, the output unit comprises a number of electrodes of a cochlear implant or a vibrator of a bone conducting hearing device. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

In an embodiment, the hearing device is a relatively small device. In an embodiment, the hearing device has a maximum outer dimension of the order of 0.15 m (e.g. a handheld mobile telephone). In an embodiment, the hearing device has a maximum outer dimension of the order of 0.08 m (e.g. a head set). In an embodiment, the hearing device has a maximum outer dimension of the order of 0.04 m (e.g. a hearing instrument).

In an embodiment, the hearing device is portable device, e.g. a device comprising a local energy source, e.g. a battery, e.g. a rechargeable battery.

In an embodiment, the hearing device comprises a forward or signal path between an input transducer (microphone system and/or direct electric input (e.g. a wireless receiver)) and an output transducer. In an embodiment, the signal processing unit is located in the forward path. In an embodiment, the signal processing unit is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, the hearing devices comprise an analogue-to-digital (AD) converter to convert an analogue electric signal representing an acoustic signal to a digital audio signal. In the AD converter, the analogue signal is sampled with a predefined sampling frequency or rate $f_s$, $f_s$ being e.g. in the range from 8 kHz to 40 kHz (adapted to the particular needs of the application) to provide digital samples $x_n$ (or x[n]) at discrete points in time $t_n$ (or n).

In an embodiment, the hearing devices comprise a digital-to-analogue (DA) converter to convert a digital signal to an analogue output signal, e.g. for being presented to a user via an output transducer.

In an embodiment, the hearing device, e.g. a microphone unit, comprises a TF-conversion unit for providing a time-frequency representation (k,n) of an input signal. In an embodiment, the time-frequency representation comprises an array or map of corresponding complex or real values of the signal in question in a particular time (index n) and frequency (index k) range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. In an embodiment, a signal of the forward and/or analysis path of the hearing device is split into a number NI of frequency bands, where NI is e.g. larger than 5, such as larger than 10, such as larger than 50, such as larger than 100, such as larger than 500, at least some of which are processed individually. In an embodiment, the hearing device is/are adapted to process a signal of the forward and/or analysis path in a number NP of different frequency channels (NP≤NI), each channel comprising a number of frequency bands. The frequency channels may be uniform or non-uniform in width (e.g. increasing in width with frequency), overlapping or non-overlapping.

In an embodiment, the hearing device further comprises other relevant functionality for the application in question, e.g. feedback suppression, compression, noise reduction, etc.

In an embodiment, the hearing device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof.

Use:

In an aspect, use of a hearing device as described above, in the 'detailed description of embodiments' and in the claims, is moreover provided.

A Method:

In an aspect, a method of operating a hearing device, the method comprising (the following steps)

- picking up sound from a sound field including a target sound source in the environment of the hearing device, by providing M electric input signals,
- defining a look vector d(k) as an M-dimensional vector comprising elements $d_m(k)$, m=1, 2, . . . , M, the $m^{th}$ element $d_m(k)$ defining an acoustic transfer function from the target signal source to the $m^{th}$ microphone, or a relative acoustic transfer function from the $m^{th}$ (input) microphone to a reference microphone, where k is a frequency index,
- providing an estimate $d_{est}(k)$ of the look vector d(k) for the currently relevant target sound source,
- providing a generalized sidelobe canceller structure for estimating e(k,n) of a target signal s(k,n) from said target sound source based on said M electric input signals and said estimate $d_{est}(k)$ of the look vector d(k), where n is a time index, a target direction being defined from the hearing device to the target sound source, the estimation of said target signal comprising
  - providing an all-pass beamformer configured to leave all signal components from all directions un-attenuated, and providing all-pass signal $y_c(k,n)$, and
  - providing a target-cancelling beamformer configured to maximally attenuate signal components from the target direction, and providing target-cancelled signal vector $y_b(k,n)$, where $y_b(k,n)=[y_{b,1}(k,n), \ldots, y_{b,M-1}(k,n)]^T$, and $y_{b,i}(k,n)$ is the $i^{th}$ target-cancelled signal,
  - generating a scaling vector h(k,n) applied to the target-cancelled signal vector $y_b(k,n)$ providing scaled, target-cancelled signal $y_n(k,n)$, subtracting said scaled, target-cancelled signal $y_n(k,n)$ from said all-pass signal $y_c(k,n)$, thereby providing said estimate e(k,n) of said target signal s(k,n) is furthermore provided by the present application. The method further comprises providing that said scaling vector h(k,n) is made dependent on a difference $\Delta_i(k,n)$ between the energy of the all-pass signal $y_c(k,n)$ and the target-cancelled signal $y_{b,i}(k,n)$, where i is an index from 1 to M−1.

It is intended that some or all of the structural features of the device described above, in the 'detailed description of embodiments' or in the claims can be combined with embodiments of the method, when appropriately substituted by a corresponding process and vice versa. Embodiments of the method have the same advantages as the corresponding devices.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application. In addition to being stored on a tangible medium such as diskettes, CD-ROM-, DVD-, or hard disk media, or any other machine readable medium, and used when read directly from such tangible media, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Hearing Assistance System:

In a further aspect, a hearing assistance system comprising a hearing device as described above, in the 'detailed description of embodiments', and in the claims, AND an auxiliary device is moreover provided.

In an embodiment, the system is adapted to establish a communication link between the hearing device and the auxiliary device to provide that information (e.g. control and status signals, possibly audio signals) can be exchanged or forwarded from one to the other.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device. In an embodiment, the auxiliary device is or comprises a remote control for controlling functionality and operation of the hearing device(s). In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth or some other standardized or proprietary scheme).

In an embodiment, the auxiliary device is or comprises a cellular telephone, e.g. a SmartPhone.

In an embodiment, the auxiliary device is another hearing device. In an embodiment, the hearing assistance system comprises two hearing devices adapted to implement a binaural hearing assistance system, e.g. a binaural hearing aid system.

DEFINITIONS

In the present context, a 'hearing device' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing device may comprise a single unit or several units communicating electronically with each other.

More generally, a hearing device comprises an input transducer for receiving an acoustic signal from a user's surroundings and providing a corresponding input audio signal and/or a receiver for electronically (i.e. wired or wirelessly) receiving an input audio signal, a signal processing circuit for processing the input audio signal and an output means for providing an audible signal to the user in dependence on the processed audio signal. In some hearing devices, an amplifier may constitute the signal processing circuit. In some hearing devices, the output means may comprise an output transducer, such as e.g. a loudspeaker for providing an air-borne acoustic signal or a vibrator for providing a structure-borne or liquid-borne acoustic signal. In some hearing devices, the output means may comprise one or more output electrodes for providing electric signals.

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory cortex and/or to other parts of the cerebral cortex.

A 'hearing assistance system' refers to a system comprising one or two hearing devices, and a 'binaural hearing assistance system' refers to a system comprising one or two hearing devices and being adapted to cooperatively provide audible signals to both of the user's ears. Hearing assistance systems or binaural hearing assistance systems may further comprise 'auxiliary devices', which communicate with the hearing devices and affect and/or benefit from the function of the hearing devices. Auxiliary devices may be e.g. remote controls, audio gateway devices, mobile phones, public-address systems, car audio systems or music players. Hearing devices, hearing assistance systems or binaural hearing assistance systems may e.g. be used for compensating for a hearing-impaired person's loss of hearing capability, augmenting or protecting a normal-hearing person's hearing capability and/or conveying electronic audio signals to a person.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

DETAILED DESCRIPTION OF EMBODIMENTS

Figure 1A:
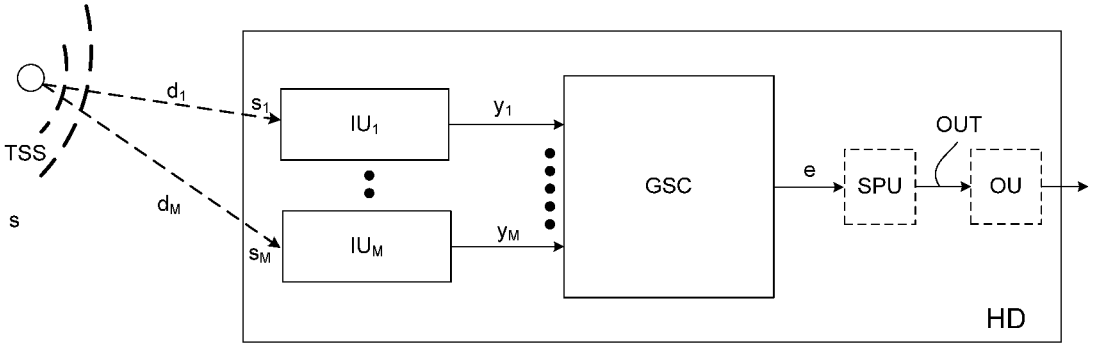
FIGS. 1A-1D show first (FIG. 1A) second (FIG. 1B), third (FIG. 1C), and fourth (FIG. 1D) embodiments of a hearing device according to the present disclosure.

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

This present application deals with an adaptive beamformer in a hearing device application using a generalized sidelobe canceller structure (GSC). In this application, the constraint and blocking matrices in the GSC structure are specifically designed using an estimate of the transfer functions between the target source and the microphones to ensure optimal beamformer performance. The estimation may be obtained in a measurement of a hearing device, which is placed on a head-and torso-simulator. When using such estimated transfer functions, the GSC may—unintentionally—attenuate the target sound in a special but realistic situation where all signals, including the target and noise signals, originate from the look direction reflected by the look vector. This is due to a non-ideal blocking matrix (for the look direction) in the GSC structure.

In hearing devices, a microphone array beamformer is often used for spatially attenuating background noise sources. Many beamformer variants can be found in literature, see, e.g., [Brandstein & Ward; 2001] and the references therein. The minimum variance distortionless response (MVDR) beamformer is widely used in microphone array signal processing. Ideally the MVDR beamformer keeps the signals from the target direction (also referred to as the look direction) unchanged, while attenuating sound signals from other directions maximally. The generalized sidelobe canceller (GSC) structure is an equivalent representation of the MVDR beamformer offering computational and numerical advantages over a direct implementation in its original form. In this work, we focus on the GSC structure in a hearing device application.

FIG. 1 shows first (FIG. 1A) second (FIG. 1B), third (FIG. 1C), and fourth (FIG. 1D) embodiments of a hearing device according to the present disclosure (e.g. a hearing aid).

FIG. 1A illustrates an embodiment of the GSC structure (GSC) embodied in a hearing device (HD). A target signal source (TSS, signal s) is located at a distance relative to the hearing device. The hearing device comprises a number M of input units ($IU_m$, m=1, 2, . . . , M), e.g. input transducers, such as microphones, e.g. a microphone array. Each input unit ($IU_m$) receives a version $s_m$ (m=1, 2, . . . , M) of the target signal s as modified by respective transfer functions $d_m$ (m=1, 2, . . . , M) from the target signal source (TSS) to the respective input units ($IU_m$). A look vector d is defined as $d=[d_1, \ldots, d_M]^T$. Each of the input units $IU_m$ provide as an output an electric input signal $y_m$ (m=1, 2, . . . , M). The input units ($IU_m$) are operationally connected to the Generalized Sidelobe Structure (GSC). The GSC beamformer provides an estimate e of the target signal based on electric input signals from the input unit. The hearing device (HD) may optionally comprise a signal processing unit (SPU, dashed outline) for further processing the estimate e of the target signal. In an embodiment, the signal processing unit (SPU) is adapted to provide a frequency dependent gain and/or a level dependent compression and/or a transposition (with or without frequency compression) of one or frequency ranges to one or more other frequency ranges, e.g. to compensate for a hearing impairment of a user. The signal processing unit (SPU) provides processed output signal OUT and is operationally connected to an optional output unit (OU, dashed outline) for providing a stimulus perceived by the user as an acoustic signal based on the processed electric output signal. The output unit (OU) may e.g. comprise a number of electrodes of a cochlear implant. Alternatively, the output unit comprises an output transducer, such as a receiver (loudspeaker) for providing the stimulus as an acoustic signal to the user, or a vibrator for providing the stimulus as mechanical vibration of a skull bone to the user.

Figure 1B:
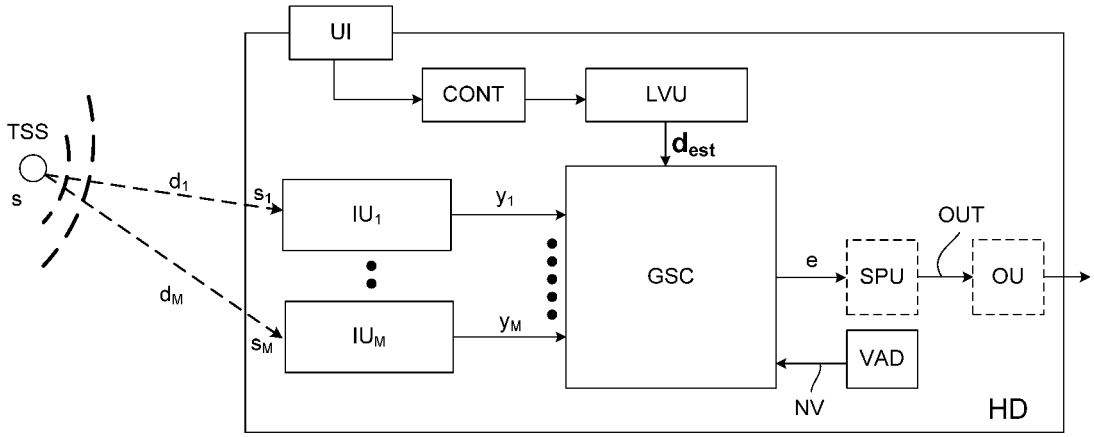

FIG. 1B illustrates an embodiment of a hearing device (HD) as shown in FIG. 1A, but further comprising a look vector estimation unit (LVU) for providing an estimate $d_{est}$ of the look vector d. The look vector d is defined as an M-dimensional vector comprising elements $d_m$, m=1, 2, . . . , M, the $m^{th}$ element $d_m$ defining an acoustic transfer function from the target signal source s to the $m^{th}$ input unit $IU_m$, (each comprising e.g. a microphone) or the relative acoustic transfer function from the $m^{th}$ input unit to a reference unit. The look vector d will typically be frequency dependent, and may be time dependent (if the target source and hearing device move relative to each other). The look vector estimation unit (LVU) may e.g. comprise a memory storing an estimate of the individual transfer functions $d_m$ (e.g. determined in an off-line procedure in advance of a use of the hearing device, or estimated during use of the hearing device). In the embodiment of FIG. 1B, the hearing device (HD) further comprises a control unit (CONT) and a user interface (UI) in operational connection with the look vector estimation unit (LVU). The look vector estimation unit (LVU) may e.g. be controlled by a control unit (CONT) to load a relevant estimate $d_{est}$ of a look vector d in a given situation, e.g. controlled or influenced via the user interface (UI), e.g. by choosing among a number of predetermined locations of (e.g. directions to) the target sound source having pre-stored corresponding look vectors. Alternatively, the look vector d may be dynamically determined (estimated). The hearing device (HD) of FIG. 1B further comprises a voice activity (or speech) detector (VAD) for—at a given point in time—estimating whether or not a human voice is present in a sound signal. In an embodiment, the voice activity detector is adapted to estimate—at a given point in time—whether or not a human voice is present in a sound signal at a given frequency. The voice activity detector may be configured to monitor one (e.g. a single) or more of the electric input signals $y_m$ (possibly each of them).

Figure 1C:
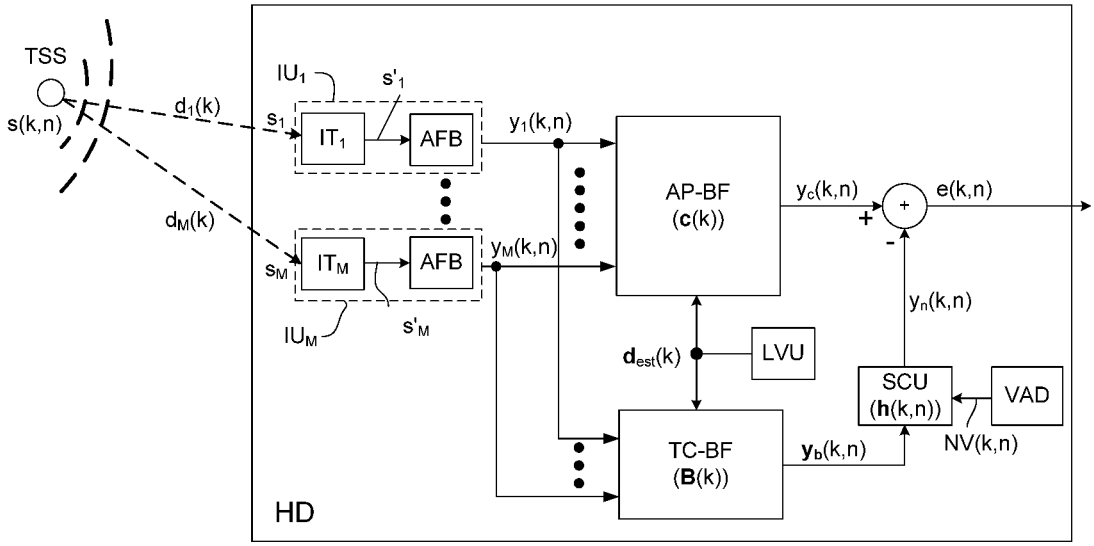

FIG. 1C illustrates an embodiment of a hearing device (HD) as in FIG. 1B, but where embodiments of the GSC beamformer and the input units are shown in more detail. All signals are represented in the frequency domain. Hence, each of the input units ($IU_m$) (m=1, 2, . . . , M) comprises an input transducer ($IT_m$, e.g. a microphone) providing time variant electric input signal $s'_m$, connected to an analysis filter bank (AFB) for converting a time domain signal ($s'_m$) to a (time-)frequency domain microphone signal ($y_m(k,n)$). The target source signal is denoted by s(k,n), where k is a frequency index and n is a time index; $d_m(k)$ is the transfer function from s(k,n) to the $m^{th}$ input transducer ($IT_m$, e.g. a microphone), where m=1, . . . , M, and the input transducer/microphone signals are denoted by $y_m(k,n)$. For convenience, we assume the transfer functions to be time-invariant. The generalized sidelobe canceller GSC comprises functional units AP-BF (c(k)), TC-BF (B(k)), SCU (h(k,n)) and combination unit (here adder, +). The look vector estimation unit (LVU) and the voice activity detector (VAD) may or may not be included in the GSC-unit (in FIG. 1B shown outside the GSC unit). In the AP-BF (c(k)) unit, c(k) $\epsilon C^{M\times 1}$ (where C denotes the set of complex numbers) denotes the time-invariant constraint vector, which is also referred to as an all-pass beamformer (AP-BF). In the TC-BF (B(k)) unit, B(k) $\epsilon C^{(M-1)\times 1}$ denotes the blocking (or target-cancelling) beamformer (TC-BF). In the SCU (h(k,n)) unit, the scaling vector h(k, n) $\epsilon C^{(M-1)\times 1}$ is obtained by minimizing the mean square error of the GSC output signal e(k,n). Ideally, the all-pass beamformer c(k) does not modify the target signal from the look direction. The target-cancelling beamformer B(k) is orthogonal to c(k), and it has nulls in the look direction and should thereby (ideally) remove the target source signal completely.

Figure 1D:
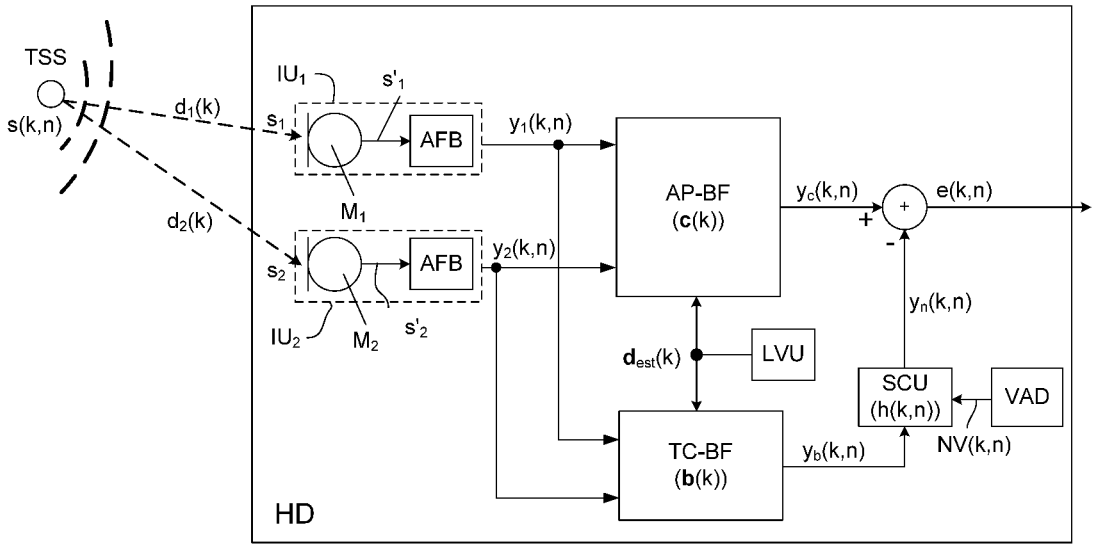

FIG. 1D illustrates an embodiment of a hearing device (HD) as shown in FIG. 1C, but which—for simplicity—only comprises two input transducers (here two microphones $M_1$, $M_2$), i.e., M=2. However, the theory and results obtained can be easily adapted and used for cases where M>2. As a result of choosing M=2, the matrix B(k) becomes a vector b(k), its output signal vector $y_b(k,n)$ is a scalar $y_b(k,n)$, and the scaling vector h(k,n) is a scaling factor h(k,n). As illustrated in FIG. 1D, the output e(k,n) (at time instance n and frequency k) of the GSC-beamformer is equal to $y_c(k,n)-y_b(k,n)\cdot h(k,n)$.

It is well-known that the MVDR beamformer, despite the distortionless response constraint, can cancel the desired signal from the look direction. This would, e.g., be the case in a reverberant room, when reflections of the desired target signal pass through the target-cancelling beamformer, and its output signal $y_b(k,n)$ is thereby correlated with the target signal. Target-cancellation can also occur due to look vector estimation errors. Some sophisticated solutions to this problem exist, such as introducing an adaptive target-cancelling beamformer B(k,n), or taking the probability of look vector errors into account when designing the beamformer, and the suggestion of a more accurate look vector estimation.

In the present application, a simple solution (to a specific instance) is proposed. The present disclosure presents a simple modification to the GSC structure, which solves the problem of undesired target signal attenuation in situations where all signals originate from the look direction. An example of the problem and its solution is outlined in the following.

Figure 2:
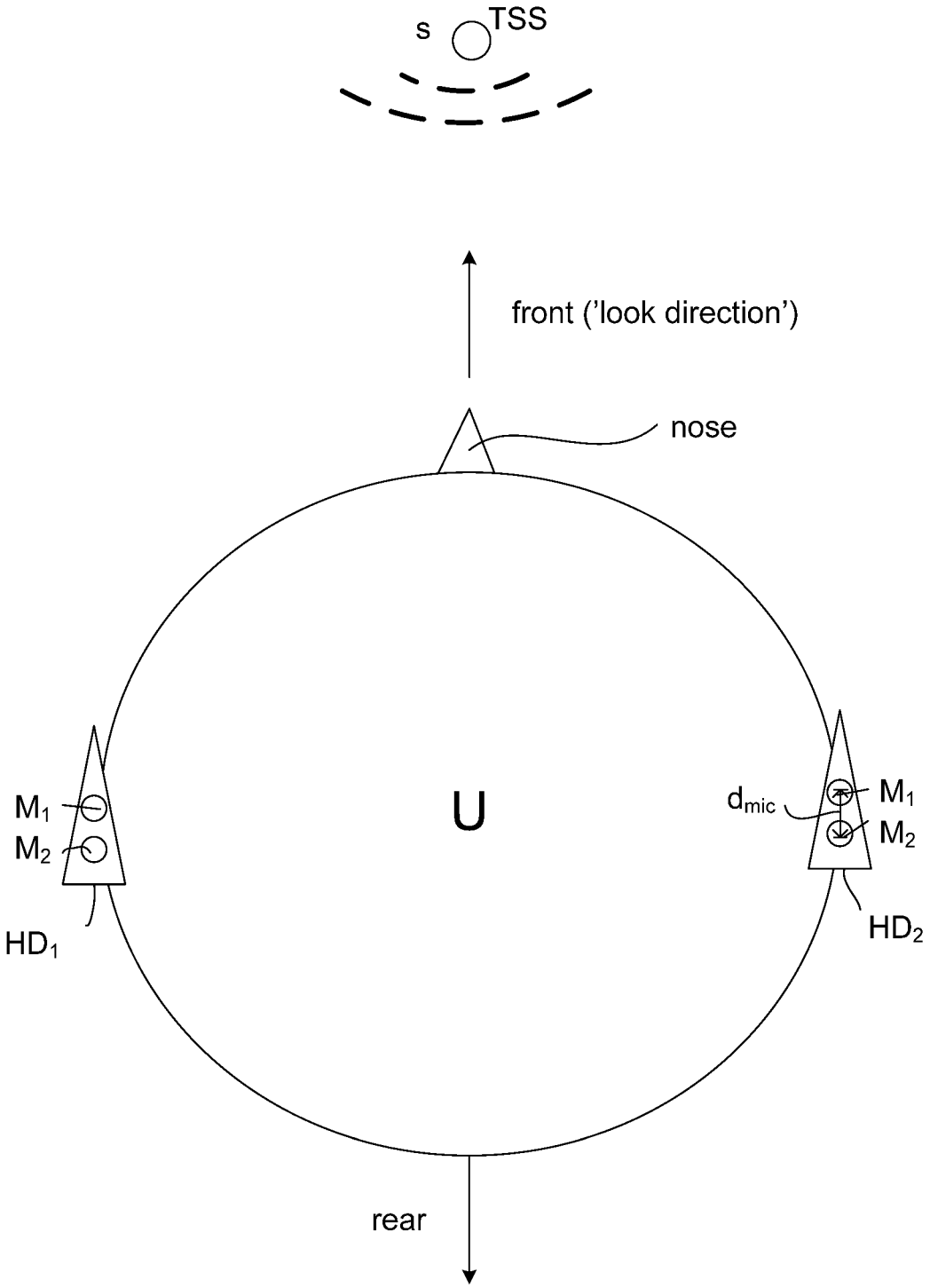
FIG. 2 shows an exemplary hearing device system comprising first and second hearing devices mounted at first and second ears of a user and defining front and rear directions relative to the user, a front ('look direction') being defined as the direction that the user currently looks ('the direction of the nose')

FIG. 2 shows an exemplary hearing device system comprising first and second hearing devices ($HD_1$ and $HD_2$, respectively) mounted at first and second ears of a user (U) and defining front (arrow denoted front) and rear (arrow denoted rear) directions relative to the user, a 'look direction' from the input units (microphones $M_1$, $M_2$) towards the target sound source (TSS, s) being defined as the direction that the user currently looks (assumed equal to the front direction (front), i.e. 'the direction of the nose' (nose in FIG. 2)). Each of the first and second hearing devices ($HD_1$, $HD_2$) comprises (a microphone array comprising) first and second microphones $M_1$ and $M_2$, respectively, located with a spacing of $d_{mic}$.

The all-Pass and Target-Cancelling Beamformers:

In free field conditions, the look vector d can be easily determined. It is assumed that the hearing aid user faces the sound source, and this direction (0 degrees) is defined as the look direction (cf. look direction in FIG. 2). The target sound and the two microphones $M_1$, $M_2$ are located in the horizontal plane. Using a virtual reference microphone, i.e., $d_{ref}=1$, located in the middle between the physical microphones, the (free filed) look vector $d_0$ becomes $$d_0 = \left[e^{-j\omega\frac{T_d}{2}}, e^{j\omega\frac{T_d}{2}}\right]^T, \tag{1}$$

where $\omega=2\pi f$, and $T_d=d_{mic}/c_l$ where f is the frequency, $d_{mic}$ is the distance between the two microphones, and $c_l$ represents the sound speed of $c_l\approx 340$ m/s. Furthermore, a unit-norm version d of $d_0$ is defined as $$d = \frac{d_0}{\|d_0\|}. \tag{2}$$

The all-pass beamformer c and the target-cancelling beamformer b are given by definition $$c^H d=1 \wedge b^H d=0. \tag{3}$$

Hence, $$c=d, \tag{4}$$

$$b=[d_2,-d_1]^H. \tag{5}$$

By inserting equation (2) in equations (4) and (5) the beamformer coefficients of these two beamformers can be determined.

Figure 3A:
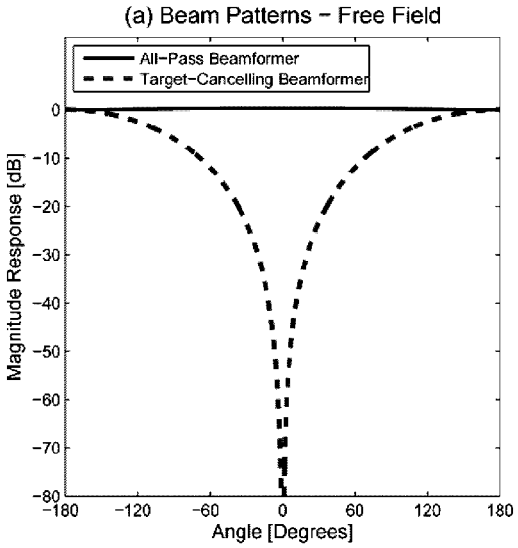
FIGS. 3A-3B show beam patterns for a generalized sidelobe canceller structure when the look direction is 0 degrees FIG. 3A illustrating a calculated free field approximation, FIG. 3B illustrating a measured acoustic field, the solid and dashed graphs representing the all-pass and target-cancelling beamformers, respectively.
Figure 3B:
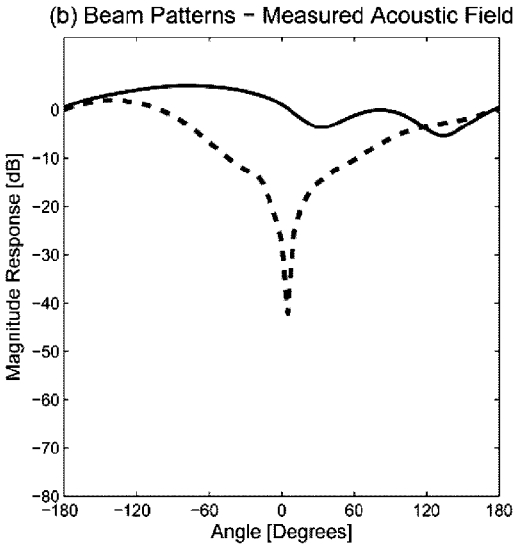

FIG. 3 shows beam patterns (Magnitude [dB] versus Angle from −180° to) 180° for a generalized sidelobe canceller structure when the look direction is 0 degrees FIG. 3A illustrating a calculated free field approximation, FIG. 3B illustrating a measured acoustic field, the solid and dashed graphs representing the all-pass and target-cancelling beamformers, respectively.

FIG. 3A illustrates the beam patterns for an example frequency f=1 kHz of a microphone array with a microphone distance $d_{mic}=13$ mm. As expected, the all-pass beamformer c has unit response in the look direction (0 degrees), whereas the target-cancelling beamformer b has a perfect null in this direction (Although we can only observe that the magnitude is below −80 dB).

In practice, however, the transfer functions $d_m$ are not simply expressed as in equation (2). Therefore, we need to derive the beamformer coefficients from the look vector estimate $d_{est}$. Hence, equations (4) and (5) become $$c=d_{est}, \tag{6}$$

$$b=[d_{est,2},-d_{est,1}]^H \tag{7}$$

To estimate $d_{est}$, a hearing aid has been mounted on a head-and-torso simulator in a sound studio. A white noise target signal s(n) was played, impinging from the look direction (0 degrees). The microphone signal vector $y(n)=[y_1(n), \ldots, y_M(n)]^T$ is defined as $$y(n)=s(n)d. \tag{8}$$

The microphone signal covariance matrix $R_{yy}=E[y(n)y^H(n)]$, where E[•] denotes the statistical expectation operator, can be estimated as $$\hat{R}_{yy} = \frac{1}{N}\sum_{n=1}^{N} y(n)y^H(n), \tag{9}$$

where N is determined by the duration of the white noise calibration signal s(n). From (9), the look vector estimate $d_{est}$ can be found using the eigenvector corresponding to the largest eigenvalue of the covariance matrix estimate $\hat{R}_{yy}$, where this eigenvector is further normalized to have unit-norm.

FIG. 3B illustrates the beam patterns for an example frequency f=1 kHz in a real acoustic field. We observe that the all-pass beamformer (solid graph) only approximates a unity response; more importantly, however, the target-cancelling beamformer (dashed graph) does not have a perfect null, but it has an attenuation of approximately 35 dB. Increasing the value of N leads to a larger attenuation. However, in real applications, only a finite value of this attenuation can be realized, rather than the theoretically desired response of −∞ dB when $\lim_{N\to\infty} d_{est}=d$. In other words, the target-cancelling problem will occur whenever N≠∞, and we will thus in practice only obtain a finite attenuation of the target signal from the look direction.

The minimization of the output signal e(k,n), and in particular the target-cancelling problem, is outlined in the following.

The GSC output signal e(k,n) is expressed by $$e(k,n)=y_c(k,n)-h(k,n)y_b(k,n), \tag{10}$$

as indicated in FIG. 1C, 1D. To ensure that the GSC beamformer does not attenuate desired (e.g. speech) signals, the scaling factor h(k,n) is estimated during noise-only periods, i.e., when the voice activity detector (VAD) indicates a 'noise only' situation (cf. signal NV(k,n) in FIG. 1C, 1D). The computation of h(k,n) is expressed by $$h_{opt}(k,n)=\arg\min_{h(k,n)} E[|e(k,n)|^2], \text{when } VAD=0, \tag{11}$$

where E[•] denotes the statistical expectation operator. The closed form solution of equation (11) is $$h(k,n) = \frac{E[y_b^*(k,n)y_c(k,n)]}{E[y_b^*(k,n)y_b(k,n)+\delta]}, \text{ when } VAD=0, \tag{12}$$

where δ>0 is a regularization parameter.

The present disclosure deals specifically with the acoustic situation where the target and all noise signals originate from the look direction. In the ideal situation, the output signal $y_c(k,n)$ of the all-pass beamformer c contains a mixture of the target and the noise signals due to the unity response of the all-pass-beamformer in the look direction. The output signal $y_b(k,n)$ should ideally be zero due to a perfect null in the target-cancelling beamformer b in the look direction, as illustrated in FIG. 3A. By analyzing equation (12), we obtain h(k,n)=0 since δ>0; hence, we obtain $e(k,n)=y_c(k,n)$, i.e., all signals pass unmodified through the GSC structure. This result is desired in this situation, since all signals originate from the look direction.

However, in practice, the target-cancelling beamformer b does not have a perfect null as illustrated in FIG. 3B; it has a relatively large but finite attenuation in the look direction, such as 40 dB. Analyzing again equation (12), we observe that the numerator $E[y^*_b(k,n)y_c(k,n)]$ now has a nonzero value, and the first part of the denominator $E[y^*_b(k,n)y_b(k,n)]$ is also non-zero and numerically less than the numerator. When the regularization parameter δ has a comparably smaller numerical value, the resulting scaling factor h(k,n) would be h(k,n)≠0, which is undesirable.

Figure 4:
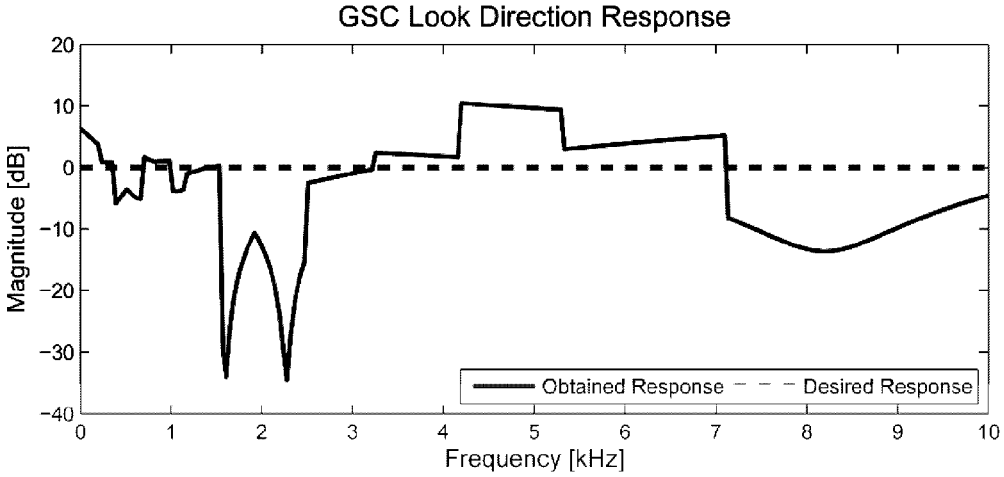
FIG. 4 shows a practical (non-ideal) magnitude response of the look direction of a generalized sidelobe beamformer structure.

FIG. 4 shows a practical (non-ideal) magnitude response (Magnitude [dB] versus Frequency [kHz], for the range from 0 to 10 kHz) of the look direction of a generalized sidelobe beamformer structure. FIG. 4 shows the transfer function of the GSC for signals from the look direction. Ideally, it should be 0 dB for all frequencies, but due to the non-ideal target-cancelling beamformer
b and the update procedure of h(k,n) in equation (12), the obtained response is far from the desired. An attenuation of more than 30 dB is observed at some frequencies (around 2 kHz in the example of FIG. 4).

In fact, the response in FIG. 4 can be considered as an exaggerated example to demonstrate the problem, since all signals originate from the look direction. However, the target-cancelling problem would also have influence, although reduced, in other situations, e.g., with a dominating target signal from the look directions, and low-level noise signals are coming from other directions.

Additionally, if the target source is located just off the look direction, e.g., 5 degrees to one side because the hearing aid user is not facing directly to the sound source, then this source signal would pass through the target cancelling beamformer with a finite attenuation, both in the ideal or non-ideal situations as illustrated in FIG. 3. The GSC structure will partially remove this signal even though it is considered to be the target signal.

In the following, a modification to the scaling factor update in equation (12) to resolve the target-cancelling problem is outlined. The simplicity of this solution makes it attractive in hearing aids with only limited processing power.

As previously mentioned, the problem in the specific case where all signal sources are located in the look direction is caused by a non-ideal target-cancelling beamformer b. As a consequence, the denominator gets smaller than the numerator in equation (12). A fixed regularization parameter δ cannot solve this problem, since the target source level affects the numerical values of the numerator and the denominator.

To solve this problem, it is proposed to introduce a dependency of the estimation of h(k,n) on the difference Δ(k,n) between the energy of the beamformer output signals $y_c(k,n)$ and $y_b(k,n)$, expressed by $$\Delta(k,n) = \frac{\sum_{l=0}^{L-1} |y_c(k,n-l)|^2}{\sum_{l=0}^{L-1} |y_b(k,n-l)|^2},$$

where L is the number of data samples used to compute Δ(k,n).

The difference Δ(k,n) is largest, when all signal sources are located in the look direction. This would be the case for either ideal or non-ideal target-cancelling beamformer b, since the target-cancelling beamformer has a null (even if it is non-ideal) in the look-direction, see also the examples in FIG. 3. Therefore, it is proposed to monitor the difference Δ(k,n) to control the estimation of the scaling factor h. A modified scaling factor $h_{mod}$(k,n) is thereby introduced, and it is defined as $$h_{mod}(k,n) = \begin{cases} h(k,n) & \text{for } \Delta(k,n) \le \eta \\ 0 & \text{otherwise} \end{cases}, \quad (14)$$

The threshold value η is determined by the difference between the magnitude responses of the all-pass beamformer c and the target-cancelling beamformer b in the look direction. In the example shown in FIG. 3B, an appropriate η-value would for instance be η=30 dB. In general, the threshold value may be adapted to the specific application (and optionally dependent on frequency).

It can be shown that in the case where all (target) source signals impinge from the front, and where the mixture input signal contains a speech signal in noise, the (traditional) GSC beamformer has a relatively large mean square error compared to the modified GSC beamformer according to the present disclosure. This indicates that undesired target signal cancellation takes place in the traditional GSC beamformer, whereas the modified GSC beamformer according to the present disclosure resolves the problem, as expected. It can further be shown that there is no difference between these two GSC structures in the five additional sound environments ('Car', 'Lecture', 'Meeting', 'Party', 'restaurant') indicating that the proposed GSC modification does not introduce artifacts in (those) other situations.

FIG. 5 shows an exemplary application scenario of an embodiment of a hearing assistance system according to the present disclosure.

Figure 5A:
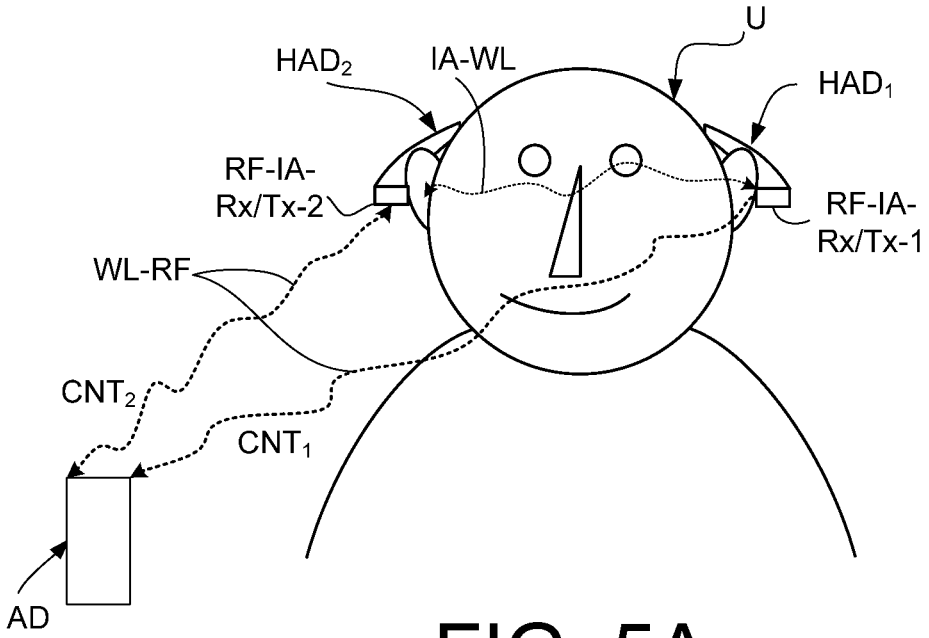
FIGS. 5A-5B show an exemplary application scenario of an embodiment of a hearing assistance system according to the present disclosure, FIG. 5A illustrating a user, a binaural hearing aid system and an auxiliary device comprising a user interface for the system, and FIG. 5B illustrating the user interface implemented on the auxiliary device running an APP for initialization of the directional system.
Figure 5B:
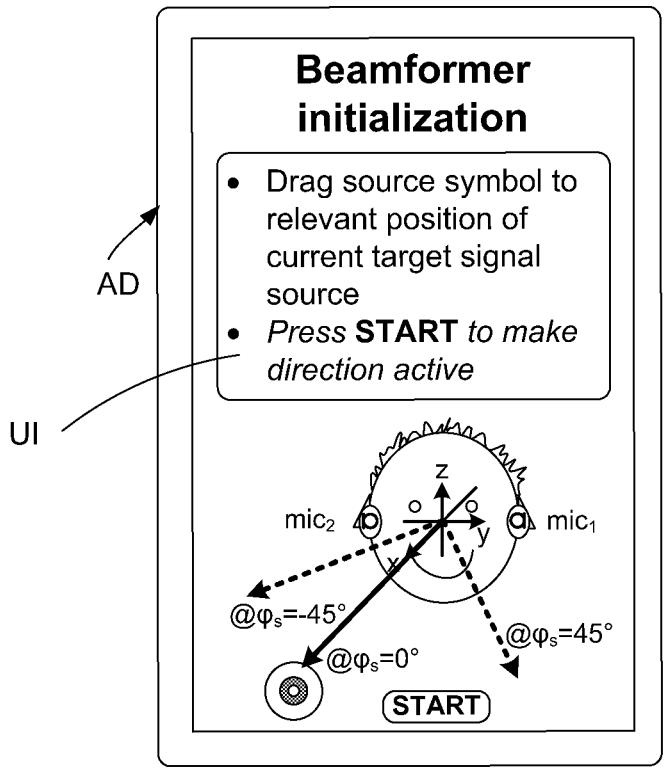

FIG. 5A shows an embodiment of a binaural hearing assistance system, e.g. a binaural hearing aid system, comprising left (first) and right (second) hearing devices ($HAD_1$, $HAD_2$) in communication with a portable (handheld) auxiliary device (AD) functioning as a user interface (UI) for the binaural hearing aid system. In an embodiment, the binaural hearing aid system comprises the auxiliary device AD (and the user interface UI). The user interface UI of the auxiliary device AD is shown in FIG. 5B. The user interface comprises a display (e.g. a touch sensitive display) displaying a user of the hearing assistance system and a number of predefined locations of the target sound source relative to the user. Via the display of the user interface (under the heading Beamformer initialization), the user U is instructed to:

- 'Drag source symbol to relevant position of current target signal source'.
- 'Press START to make the chosen direction active' (in the beamforming filter, e.g. GSC in FIG. 1).

These instructions should prompt the user to

- Locate the source symbol in a direction relative to the user, where the target sound source is expected to be located (e.g. in front of the user) ($\phi_s$=0°, or at an angle different from the front, e.g. $\phi_s$=−45° or)) $\phi_s$=+45°.
- Press START to initiate the use of the chosen direction as the 'look direction' of a target aiming beamformer (cf. e.g. $d_{est}$ input to beamformer GSC in FIG. 1B).

Hence, the user is encouraged to choose a location for a current target sound source by dragging a sound source symbol (circular icon with a grey shaded inner ring) to its approximate location relative to the user (e.g. if deviating from a front direction (cf. front in FIG. 2), where the front direction is assumed as default). The 'Beamformer initialization' is e.g. implemented as an APP of the auxiliary device AD (e.g. a SmartPhone). Preferably, when the procedure is initiated (by pressing START), the chosen location (e.g. angle and possibly distance to the user), are communicated to the left and right hearing devices for use in choosing an appropriate corresponding (possibly predetermined, e.g. stored in a memory of the system/devices) set of filter weights, or for calculating such weights. In the embodiment of FIG. 5, the auxiliary device AD comprising the user interface UI is adapted for being held in a hand of a user (U), and hence convenient for displaying and/or indicating a current location of a target sound source.

The user interface illustrated in FIG. 5 may be used in any of the embodiments of a hearing device, e.g. a hearing aid, shown in FIG. 1.

Preferably, communication between the hearing device and the auxiliary device is based on some sort of modulation at frequencies above 100 kHz. Preferably, frequencies used to establish a communication link between the hearing device and the auxiliary device is below 70 GHz, e.g. located in a range from 50 MHz to 70 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). In an embodiment, the wireless link is based on a standardized or proprietary technology. In an embodiment, the wireless link is based on Bluetooth technology (e.g. Bluetooth Low-Energy technology) or a related technology.

In the embodiment of FIG. 5A, wireless links denoted IA-WL (e.g. an inductive link between the left and right assistance devices) and WL-RF (e.g. RF-links (e.g. Bluetooth) between the auxiliary device AD and the left $HAD_l$, and between the auxiliary device AD and the right $HAD_r$, hearing device, respectively) are indicated (and implemented in the devices by corresponding antenna and transceiver circuitry, indicated in FIG. 5A in the left and right hearing devices as RF-IA-Rx/Tx-I and RF-IA-Rx/Tx-r, respectively).

In an embodiment, the auxiliary device AD is or comprises an audio gateway device adapted for receiving a multitude of audio signals and adapted for allowing the selection an appropriate one of the received audio signals (and/or a combination of signals) for transmission to the hearing device(s). In an embodiment, the auxiliary device is or comprises a remote control for controlling functionality and operation of the hearing device(s). In an embodiment, the auxiliary device AD is or comprises a cellular telephone, e.g. a SmartPhone, or similar device. In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth (e.g. Bluetooth Low Energy) or some other standardized or proprietary scheme).

In the present context, a SmartPhone, may comprise

- a (A) cellular telephone comprising a microphone, a speaker, and a (wireless) interface to the public switched telephone network (PSTN) COMBINED with
- a (B) personal computer comprising a processor, a memory, an operative system (OS), a user interface (e.g. a keyboard and display, e.g. integrated in a touch sensitive display) and a wireless data interface (including a Web-browser), allowing a user to download and execute application programs (APPs) implementing specific functional features (e.g. displaying information retrieved from the Internet, remotely controlling another device, combining information from various sensors of the smartphone (e.g. camera, scanner, GPS, microphone, etc.) and/or external sensors to provide special features, etc.).

In conclusion, the present application addresses a problem which occurs when using a GSC structure in a hearing device application (e.g. a hearing aid for compensating a user's hearing impairment). The problem arises due to a non-ideal target-cancelling beamformer. As a consequence, a target signal impinging from the look direction can—unintentionally—be attenuated by as much as 30 dB. To resolve this problem, it is proposed to monitor the difference between the output signals from the all-pass beamformer and the target-cancelling beamformer to control a time-varying regularization parameter in the GSC update. An advantage of the proposed solution is its simplicity, which is a crucial factor in a portable (small size) hearing device with only limited computational power. The proposed solution may further have the advantage of resolving the target-cancelling problem without introducing other artifacts.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

[Schaub; 2008] Arthur Schaub, Digital hearing Aids, Thieme Medical. Pub., 2008.

[Brandstein & Ward; 2001] M. Brandstein and D. Ward, Microphone Arrays: Signal Processing Techniques and Applications. Berlin, Heidelberg, Germany: Springer, June 2001.

The invention claimed is:

1. A hearing device comprising a microphone array for picking up sound from a sound field including a target sound source in the environment of the hearing device, the microphone array comprising a number M of microphones for picking up each their version of the sound field around the hearing device and providing M electric input signals, a look vector d(k) being defined as an M-dimensional vector comprising elements $d_m(k)$, m=1, 2, . . . , M, the $m^{th}$ element $d_m(k)$ defining an acoustic transfer function from the target sound source to an $m^{th}$ microphone, or a relative acoustic transfer function from the $m^{th}$ microphone to a reference microphone which is one of said M microphones, where k is a frequency index, a look vector estimation unit for providing an estimate $d_{est}(k)$ of the look vector d(k) for the target sound source, a generalized sidelobe canceller for providing an estimate e(k,n) of a target signal s(k,n) from said target sound source, where n is a time index, a target direction being defined from the hearing device to the target sound source, the generalized sidelobe canceller comprising an all-pass beamformer configured to leave all signal components of the M electric input signals from all directions un-attenuated, and providing all-pass signal $y_c(k,n)$, and a target-cancelling beamformer configured to maximally attenuate signal components of the M electric input signals from the target direction, and providing target-cancelled signal $y_b(k,n)$, where $y_b(k,n)=[y_{b,1}(k,n), \ldots, y_{b,M-1}(k,n)]^T$, and $y_{b,i}(k,n)$ is the $i^{th}$ target-cancelled signal, a scaling unit for generating a scaling vector h(k,n) applied to the target-cancelled signal $y_b(k,n)$ providing scaled, target-cancelled signal $y_n(k,n)$, a combination unit for subtracting said scaled, target-cancelled signal $y_n(k,n)$ from said all-pass signal $y_c(k,n)$, thereby providing said estimate e(k,n) of said target signal s(k,n), wherein the M electric input signals from the microphone array and the look vector estimation unit are operationally connected to the generalized sidelobe canceller to provide that the generalized sidelobe canceller processes the M electric input signals from the microphone array and provides said estimate of the target signal s from the target sound source represented in the M electric input signals based on said M electric input signals and said estimate $d_{est}(k)$ of the look vector d(k), and wherein the scaling unit is configured to provide that said scaling vector h(k,n) is made dependent on a difference $\Delta_i(k,n)$ between energy of the all-pass signal $y_c(k,n)$ and energy of the target-cancelled signal $y_{b,i}(k,n)$, where i is an index from 1 to M−1.

2. A hearing device according to claim 1 further comprising a voice activity detector for, at a given point in time, estimating whether or not a human voice is present in a sound signal, wherein said scaling unit generates said scaling vector h(k,n) as a function of a result of from said voice activity detector.

3. A hearing device according to claim 2 wherein said scaling vector h(k,n) is calculated at time and frequency instances n and k, where no human voice is estimated to be present.

4. A hearing device according to claim 1 wherein said difference Δ(k,n) between the energy of the all-pass signal $y_c(k,n)$ and the energy of the target-cancelled signal $y_b(k,n)$ is expressed in accordance with a relative equation $$\Delta_i(k,n) = \frac{\sum_{l=0}^{L-1} |y_c(k,n-l)|^2}{\sum_{l=0}^{L-1} |y_{b,i}(k,n-l)|^2}$$

where i=1,2, . . . , M−1, and where L is the number of data samples used to compute $\Delta_i(k,n)$.

5. A hearing device according to claim 4 wherein the individual elements of said scaling vector h(k,n) are substituted by modified scaling factors $h_{mod,i}(k,n)$ defined by the following relation $$h_{mod,i}(k,n) = \begin{cases} h_i(k,n) & \text{for } \Delta_i(k,n) \le \eta_i \\ 0 & \text{otherwise} \end{cases},$$

where i=1, 2, . . . , M−1, and where the threshold value $\eta_i$ is determined by the difference between the magnitude responses of the all-pass beamformer c and the target-cancelling beamformer B in a look direction for each target-cancelled signal $y_{b,i}(k,n)$.

6. A hearing device according to claim 5 wherein said threshold value $\eta_i$ is in the range between 10 dB and 50 dB, e.g. of the order of 30 dB.

7. A hearing device according to claim 1 wherein the number of microphones M is equal to two, and wherein the difference Δ(k,n) between the energy of the all-pass signal $y_c(k,n)$ and the energy of the target-cancelled signal $y_b(k,n)$ is expressed in accordance with a relative equation $$\Delta(k,n) = \frac{\sum_{l=0}^{L-1} |y_c(k,n-l)|^2}{\sum_{l=0}^{L-1} |y_b(k,n-l)|^2}$$

where L is the number of data samples used to compute Δ(k,n).

8. A hearing device according to claim 7 wherein the scaling factor h(k,n) is unmodified in case the difference Δ(k,n) is smaller than or equal to a predetermined threshold value η, and wherein the scaling factor h(k,n) is zero in case the difference Δ(k,n) is larger than said predetermined threshold value η.

9. A hearing device according to claim 1 wherein the estimate $d_{est}(k)$ of said look vector d(k) for the target sound source is stored in a memory of the hearing device.

10. A hearing device according to claim 1 configured to provide that the estimate $d_{est}(k)$ of said look vector d(k) for the target sound source is dynamically determined.

11. A hearing device according to claim 1 wherein the target-cancelling beamformer does not have a perfect null in a look direction.

12. A hearing device according to claim 1 comprising a user interface allowing a user to influence the target-cancelling beamformer.

13. A hearing device according to claim 1 comprising a hearing aid, a headset, an earphone, an ear protection device or a combination thereof.

14. A method of operating a hearing device, the method comprising picking up sound from a sound field including a target sound source in the environment of the hearing device, by providing M electric input signals, defining a look vector d(k) as an M-dimensional vector comprising elements $d_m(k)$, m=1, 2, . . . , M, the $m^{th}$ element $d_m(k)$ defining an acoustic transfer function from the target sound source to an $m^{th}$ microphone, or a relative acoustic transfer function from the $m^{th}$ microphone to a reference microphone which is one of said M microphones, where k is a frequency index, providing an estimate $d_{est}(k)$ of the look vector d(k) for the target sound source, providing a generalized sidelobe canceller structure for estimating a target signal s(k,n) from said target sound source based on said M electric input signals and said estimate $d_{est}(k)$ of the look vector d(k), where n is a time index, a target direction being defined from the hearing device to the target sound source, the estimation of said target signal comprising providing an all-pass beamformer configured to leave all signal components of the M electric input signals from all directions un-attenuated, and providing all-pass signal $y_c(k,n)$, and providing a target-cancelling beamformer configured to maximally attenuate signal components of the M electric input signals from the target direction, and providing target-cancelled signal $y_b(k,n)$, where $y_b(k,n)=[y_{b,1}(k,n), \ldots, y_{b,M-1}(k,n)]^T$, and $y_{b,i}(k,n)$ is the $i^{th}$ target-cancelled signal, generating a scaling vector h(k,n) applied to the target-cancelled signal $y_b(k,n)$ providing scaled, target-cancelled signal $y_n(k,n)$, subtracting said scaled, target-cancelled signal $y_n(k,n)$ from said all-pass signal $y_c(k,n)$, thereby providing said estimate e(k,n) of said target signal s(k,n), wherein providing that said scaling vector h(k,n) is made dependent on the difference $\Delta_i(k,n)$ between energy of the all-pass signal $y_c(k,n)$ and energy of the target-cancelled signal $y_{b,i}(k,n)$, where i is an index from 1 to M−1.

15. A data processing system comprising a processor and a non-transitory computer readable medium storing program code means for causing the processor to perform the method of claim 14.

* * * * *